US006443450B1

(12) United States Patent
Antinora

(10) Patent No.: US 6,443,450 B1
(45) Date of Patent: Sep. 3, 2002

(54) SHEET STACKING APPARATUS AND METHOD

(75) Inventor: Terrance Joseph Antinora, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/727,216

(22) Filed: Nov. 30, 2000

(51) Int. Cl.[7] ..... B65H 29/20

(52) U.S. Cl. ..... 271/315; 271/187; 271/902; 270/60

(58) Field of Search ..... 271/65, 187, 315, 271/902; 270/60, 58.07

(56) References Cited

U.S. PATENT DOCUMENTS

| | | | | |
|---|---|---|---|---|
| 3,951,399 A | * | 4/1976 | Reist | 270/60 |
| 3,968,960 A | | 7/1976 | Fedor et al. | 271/187 |
| 4,118,024 A | * | 10/1978 | Gerhardt | 271/65 |
| 4,553,828 A | * | 11/1985 | Burger et al. | 271/65 |
| 5,013,026 A | * | 5/1991 | Howell | 271/187 |
| 5,188,353 A | | 2/1993 | Parks | 271/184 |
| 5,303,017 A | | 4/1994 | Smith | 355/318 |
| 5,409,201 A | | 4/1995 | Kramer | 270/53 |
| 5,522,588 A | * | 6/1996 | Soltysiak | 270/58.07 |
| 5,642,876 A | | 7/1997 | Ferrara et al. | 270/58.01 |
| 5,832,358 A | | 11/1998 | Sampath et al. | 399/405 |
| 5,842,695 A | | 12/1998 | McVeigh | 271/187 |
| 6,019,209 A | * | 2/2000 | Hara et al. | 271/315 |
| 6,131,900 A | | 10/2000 | Hou | 271/184 |

FOREIGN PATENT DOCUMENTS

| | | | |
|---|---|---|---|
| JP | 0291363 | * 12/1986 | 271/187 |

* cited by examiner

*Primary Examiner*—H. Grant Skaggs
(74) *Attorney, Agent, or Firm*—Perman & Green, LLP

(57) ABSTRACT

A document creating apparatus comprises an image transfer system and a sheet stacker for stacking sheets of material. The sheet stacker is coupled to the image transfer system and is adapted to transport the sheets of material from the image transfer system along a paper path. The sheet stacker has a rotatable disk located along the paper path. The rotatable disk receives at least two of the sheets of material. A controller is connected to the rotatable disk and controls a position of the rotatable disk. The controller rotates the rotatable disk to or past a sheet stacking position after the rotatable disk receives at least two of the sheets of material adjacent each other.

11 Claims, 6 Drawing Sheets

FIG. 1
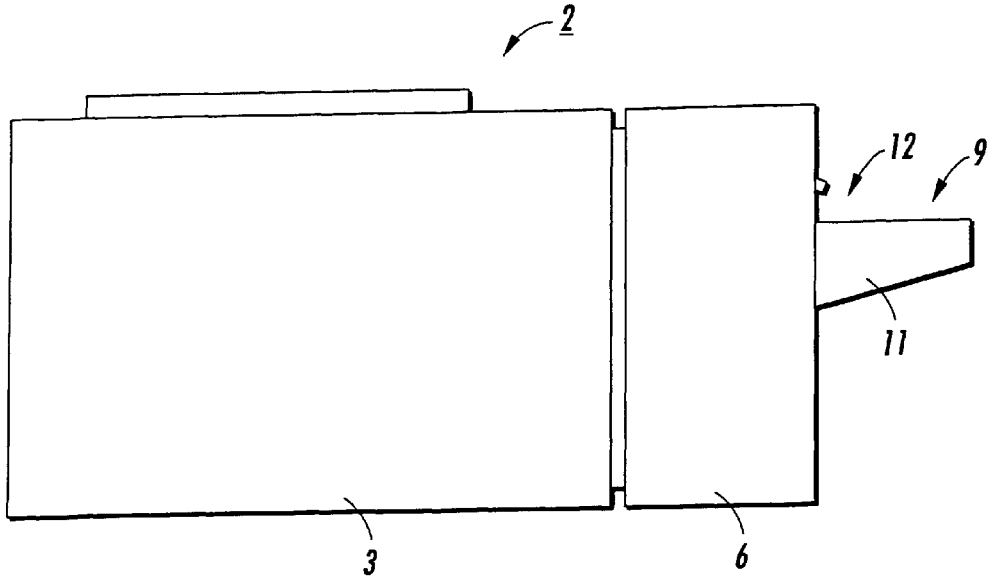
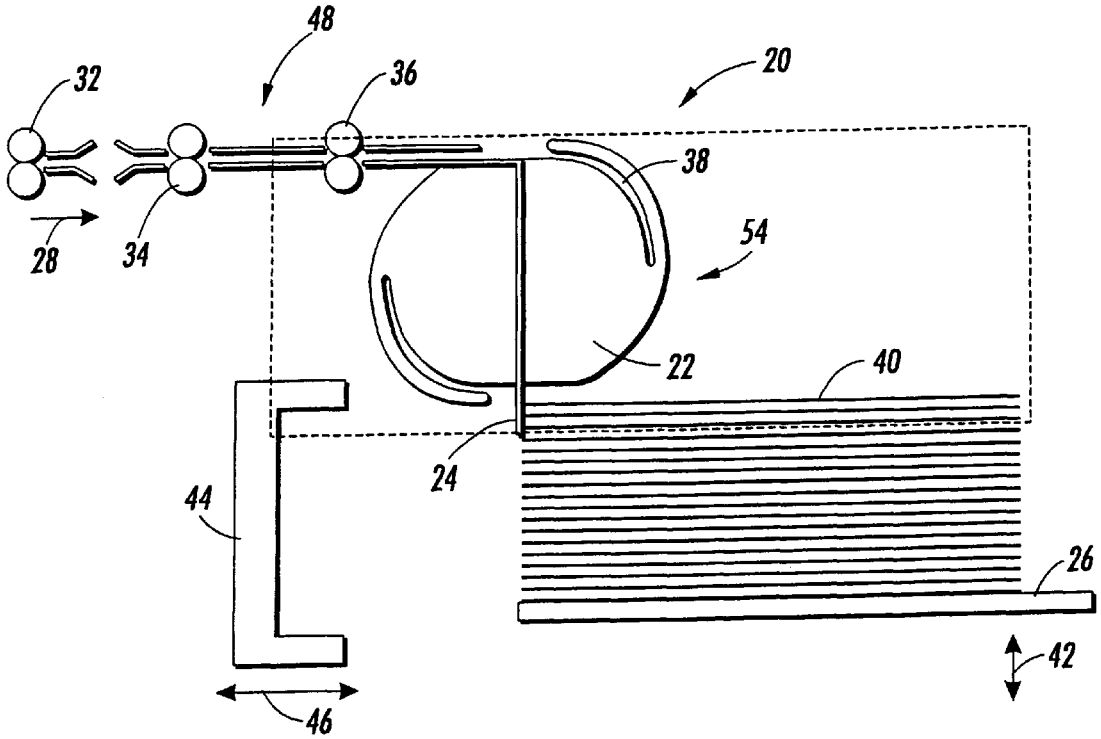
FIG. 2

FIG. 3
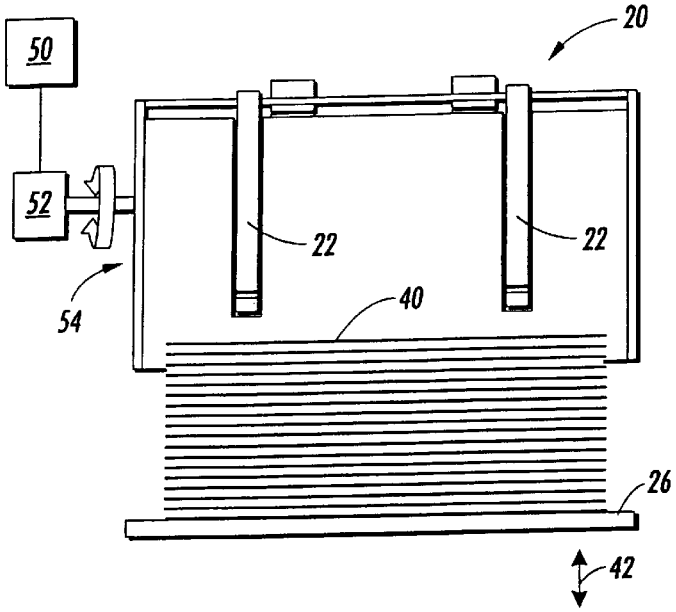
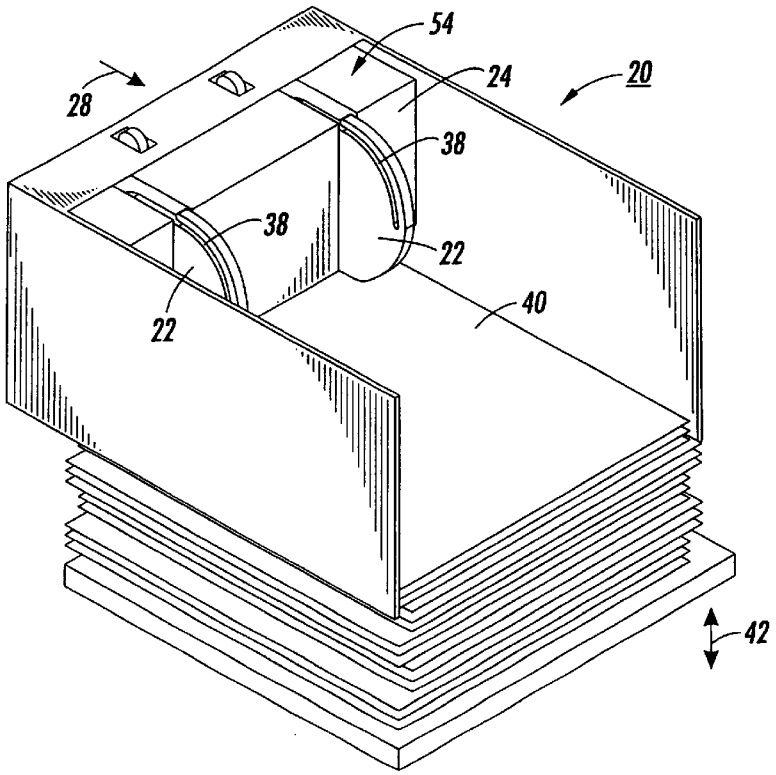
FIG. 4

SHEET STACKING APPARATUS AND METHOD

BACKGROUND OF THE INVENTION

1. Field of the Invention

The present invention relates to a sheet stacking system and, more particularly, to a sheet stacking system having a disk.

2. Prior Art

Many different sheet stacking devices are known in the sheet feeding art. For example, U.S. Pat. No. 5,188,353, which is hereby incorporated by reference in its entirety, discloses a disk stacker having a tamping mechanism located over a sheet receiving platform for tamping side edges of the sheets as they fall off the stack. After a disk stacker stacks a set of sheets, they are typically finished with a staple, eject, offset or stack height adjust operation. If the copier or printer into which the stacker has been incorporated wishes to continue operating during the finishing operation(s), the sheets being processed and fed to the stacker must either be skipped or buffered while the finishing operation is in process. Accordingly there is a desire to provide a sheet stacking device that is capable of buffering sheets while a finishing operation is being performed on a printed or copied stack of sheets.

SUMMARY OF THE INVENTION

In accordance with one embodiment of the present invention, a document creating apparatus is provided having an image transfer system for transferring images onto sheets of material and a sheet stacker coupled to the image transfer system. The sheet stacker transports the sheets of material from the image transfer system along a paper path. The sheet stacker has a rotatable disk located along the paper path that can receive at least two of the sheets of material. A controller is connected to the rotatable disk to control the position of the rotatable disk. The controller rotates the rotatable disk to or past a sheet stacking position after the rotatable disk receives at least two of the sheets of material adjacent each other.

In accordance with another embodiment of the present invention, a sheet stacker is provided for transporting and stacking sheets of material. The sheet stacker has a rotatable disk that can receive at least two of the sheets of material. A controller is connected to the rotatable disk that can reversibly control the position of the rotatable disk. After a first sheet of material is received onto the rotatable disk by forward rotation, the controller reverses the rotation of the rotatable disk. The rotatable disk can then receive a second sheet of material adjacent the first sheet of material.

In accordance with another embodiment of the present invention, a method of stacking sheets of material in a sheet stacker is provided comprising a first step of receiving a first sheet of material on a rotatable disk. The rotatable disk is then rotated in a first direction. The rotatable disk is then rotated in a reverse direction. A second sheet of material is then received adjacent the first sheet of material on the rotatable disk. The rotatable disk is then rotated with the first and second sheets of material in the first direction.

In accordance with another embodiment of the present invention, a method of stacking sheets of material in a sheet stacker is provided comprising a first step of receiving a first sheet of material on a rotatable disk. The rotatable disk is then rotated in a first location. A second sheet of material is then received adjacent the first sheet of material on the rotatable disk. The rotatable disk is then rotated past the first location.

In accordance with another embodiment of the present invention, a method of stacking sheets of material in a sheet stacker is provided comprising a first step of moving a first sheet of material into a buffering location. The buffering location includes a rotatable disk for depositing the sheets of material at a sheet stacking position. A second sheet of material is then placed adjacent the first sheet of material. During either or both of the previous steps, a stack of the sheets in the sheet stacking position is finished or moved. The first and second sheets are then placed in the sheet stacking position after the stack of sheets in the sheet stacking position has been finished or moved.

BRIEF DESCRIPTION OF THE DRAWINGS

The foregoing aspects and other features of the present invention are explained in the following description, taken in connection with the accompanying drawings, wherein:

FIG. 1 is a schematic side view of a document creating apparatus;

FIG. 2 is a schematic side view of disk stacking section;

FIG. 3 is a schematic end view of disk stacking section;

FIG. 4 is a schematic isometric view of disk stacking section;

DETAILED DESCRIPTION OF THE PREFERRED EMBODIMENT

Figure 5:
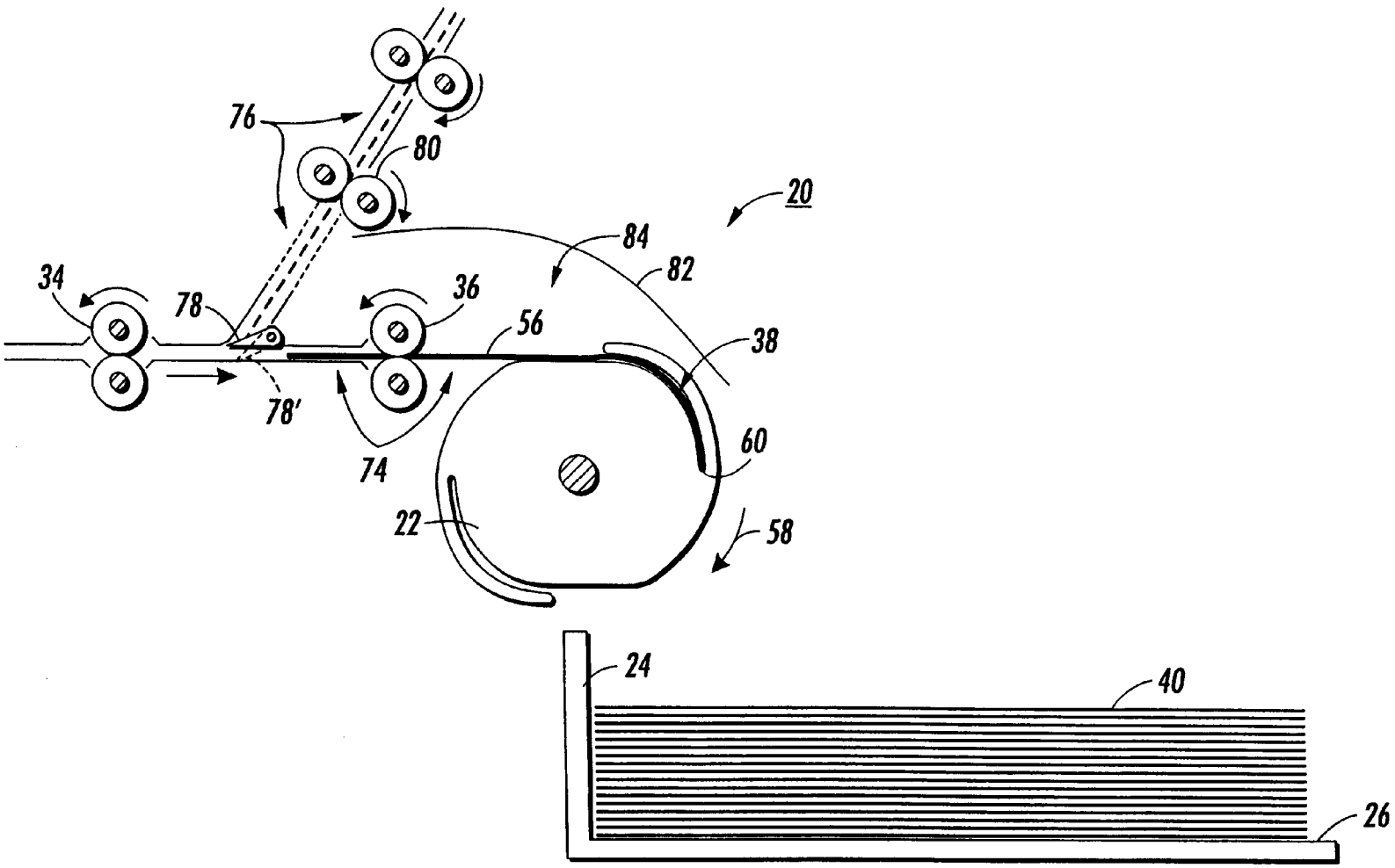
FIG. 5 is a schematic side view of a disk stacking section receiving a first sheet of material on a rotatable disk.

Referring to FIG. 1, there is shown, in schematic form, a view of a document creating apparatus 2 for creating documents in accordance with teachings of the present invention. Although the present invention will be described with reference to the single embodiment shown in the drawings, it should be understood that the present invention can be embodied in many alternate forms of embodiments. In addition, any suitable size, shape or type of elements or materials could be used. A copying or printing system of the type shown is preferably adapted to provide duplex or simplex stacked document sets from duplex or simplex collated document or print sets which result from either duplex or simplex original documents or output document computer files for print.

Document creating apparatus 2, in the embodiment shown, is a copier. However, in an alternate embodiment, the apparatus could be a printer or any other suitable type of document creating apparatus. Document creating apparatus 2 generally comprises a xerographic processing or printing section 3, a finishing section 6 and an output section 9. Printing section 3 can be an electrostatographic printing system such as made by Xerox Corporation or alternately other xerographic or other type of printing apparatus. Printing section 3 incorporates an image transfer system and a transport system for transporting sheets of material. Finishing section 6 may typically incorporate a hole punch, a stapler, a disk stacker, a binder, an indexer, or any other suitable type of finishing feature. Output section 9 incorporates a tray 11 or a bin sorter that accepts and stacks documents or document sets output from finishing section 6 at output zone 12. Documents are printed or copied in printing section 3 and output from printing section 3 to finishing section 6. Documents can be sorted, stacked and bound at finishing section 6. Document sets can be output from finishing section 6 at output zone 12.

Referring now to FIG. 2, there is shown a schematic side view of a disk stacking section. Referring also to FIG. 3 there is shown a schematic end view of disk stacking section. Referring also to FIG. 4 there is shown a schematic isometric view of disk stacking section. Disk stacker 20 includes a disk assembly 54 which has one or more rotatable disks 22 thereon, each of which includes one or more slots 38 for receiving sheets of material therein. Rotating disk 22 rotates to invert a sheet of material and register the leading edge of the sheet of material against a registration wall 24 which strips the sheet of material from the rotatable disk 22. The sheet then drops to the top of a stack of inverted sheets 40 which are supported on a vertically movable elevator 26. Elevator platform 26 is moveable in a vertical direction 42 by the actuation of a screw drive mechanism or other appropriate vertical driving mechanism (not shown). As the vertical shafts are rotated, platform 26 is raised or lowered. A stack height sensor (not shown) may be used to control the movement of platform 26 so that the top of the stack remains at substantially the same level. Disk stacker 20 may also include a tamping mechanism (not shown) which is capable of offsetting sets of sheets in a direction parallel to or perpendicular to the process direction indicated by arrow 28. Disk stacker 20 may also include a finishing mechanism 44. Finishing mechanism 44 may be a hole punch, a stapler, a binder, an indexer, or any other suitable type of finishing feature. Finishing mechanism 44 may be movable in direction 46 for the purpose of performing a finishing operation. Before entering disk stacker 20, sheets of material exit through output rollers 32 of an upstream device. The upstream device could be a printer, copier, other disk stacker, or a device for rotating sheets. Sheets may need to be rotated so that they have a certain orientation after being inverted by disk 22. The sheets can enter disk stacker 20 long edge first or short edge first. After entering stacker 20, the sheet enters predisk transport 48 where the sheet is engaged by the nip formed between one or more pairs of disk stacker input rollers 34. The sheet is directed to disk input rollers 36 which constitute part of the feeder for feeding sheets to an input position of disk 22. Input rollers 34 and 36 may operate at a known velocity which may be controlled, variable or reversible. The movement of disk 22 is controlled by a controller 50 which drives motor 52. Controller 50 is shown as a single controller, but may alternately logic circuits or part of an overall machine controller. Motor 52 is connected to the disk assembly 54. A sensor located upstream of disk 22 may detect the presence of a sheet approaching disk 22.

In a typical stacking operation, disk 22 sequentially stacks sheets of material onto stack 40. Since disk input roller 36 operates at a known velocity that may or may not be variable, the time required for the lead edge of the sheet to reach the disk slot 38 is known. As the lead edge of the sheet begins to enter the slot 38, the disk rotates through a 180 degree cycle. The disk 22 may be rotated at a velocity so that the leading edge of the sheet progressively enters the disk slot. The disk 22 may be rotated at an appropriate speed so that the leading edge of the sheet contacts registration wall 24 prior to contacting the end of the slot. Registration wall 24 may or may not be part of tray 26. The top of the sheet stack 40 is spaced from the lowermost portion of rotatable disk 22 so sheets will fall freely before coming to rest on the top of sheet stack 40. Sheets of material may then be acted upon by tampers or guides (not shown) that are used to insure alignment of all the sheets of material in the stack.

Referring now to FIG. 5 there is shown a schematic side view of disk stacking section 20 receiving a first sheet of material 56 on rotatable disk 22. When diverter 78 is in the position shown, input roller 34 feeds sheets of material toward disk input roller 36 along first paper path 74. When diverter 78 is in the position shown as dashed position 78' input roller 34 feeds sheets of material toward output roller 80 along second paper path 76. Output roller 80 may feed sheets of material to an alternate finishing apparatus, stacking apparatus, image transfer apparatus or other appropriate output device and may be reversible. Baffles 82 may be provided to assist in forming a region 84 to accommodate sheets of material handled by disk 22.

Referring now to FIG. 5 through FIG. 8, there is shown a stacking sequence according to the present invention that may be particularly useful when a finishing operation is being performed on stack of material 40. The finishing operation on stack of material 40 may be a hole punch operation, a stapling operation, a binding operation, a vertical or horizontal indexing operation, or any other suitable type of finishing operation on stack of material 40. Also included in the finishing operation may be a vertical or horizontal indexing of platform 26, a sorting operation or any other suitable type of finishing operation.

In FIG. 5 there is shown a schematic side view of disk stacking section 20 receiving a first sheet of material 56 on rotatable disk 22. Disk input roller 36 feeds first sheet of material 56 into slot 38 of rotatable disk 22 along first paper path 74. Rotatable disk 22 is at a sheet receiving position. As the lead edge of the sheet begins to enter slot 38, the disk may begin to rotate in the forward direction 58. Disk 22 may be rotated at a velocity so that the leading edge of the first sheet of material 56 progressively enters disk slot 38. Disk 22 may, but not need, be rotated at an appropriate speed so that the leading edge of the first sheet of material 56 contacts slot end 60.

Figure 6:
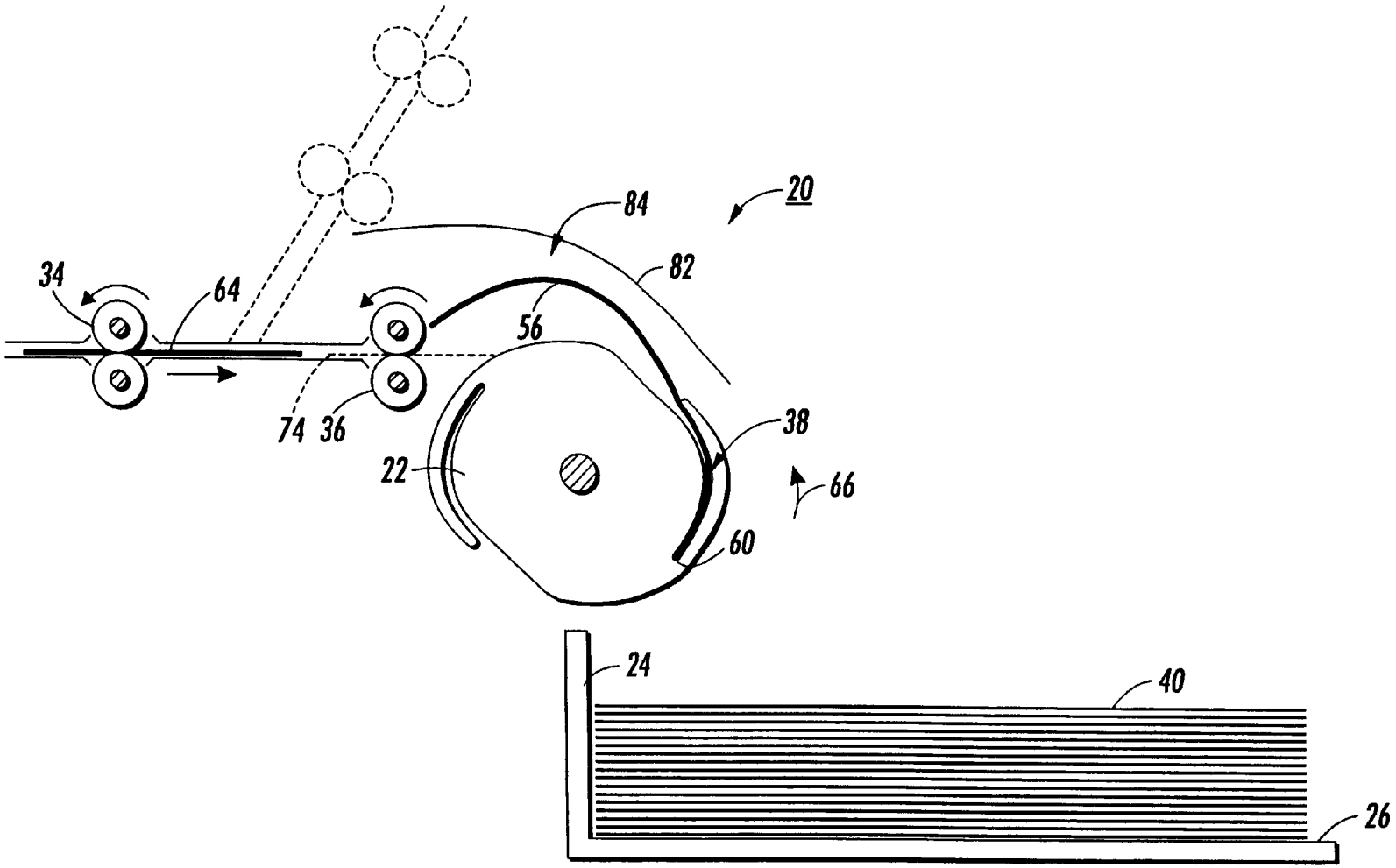
FIG. 6 is a schematic side view of a disk stacking section rotating a first sheet of material on a rotatable disk.

In FIG. 6 there is shown a schematic side view of disk stacking section 20 rotating a first sheet of material 56 on rotatable disk 22 at a first location. Disk input roller 36 feeds first sheet of material 56 into slot 38 of rotatable disk 22 until the trailing edge of first sheet of material 56 exits disk input roller 36. Input roller 34 feeds second sheet of material 64 toward disk input roller 36 along first paper path 74. After first sheet of material 56 clears disk input roller 36, disk 22 may begin to rotate in the reverse direction 66 with first sheet of material 56 extending into region 84.

Figure 7:
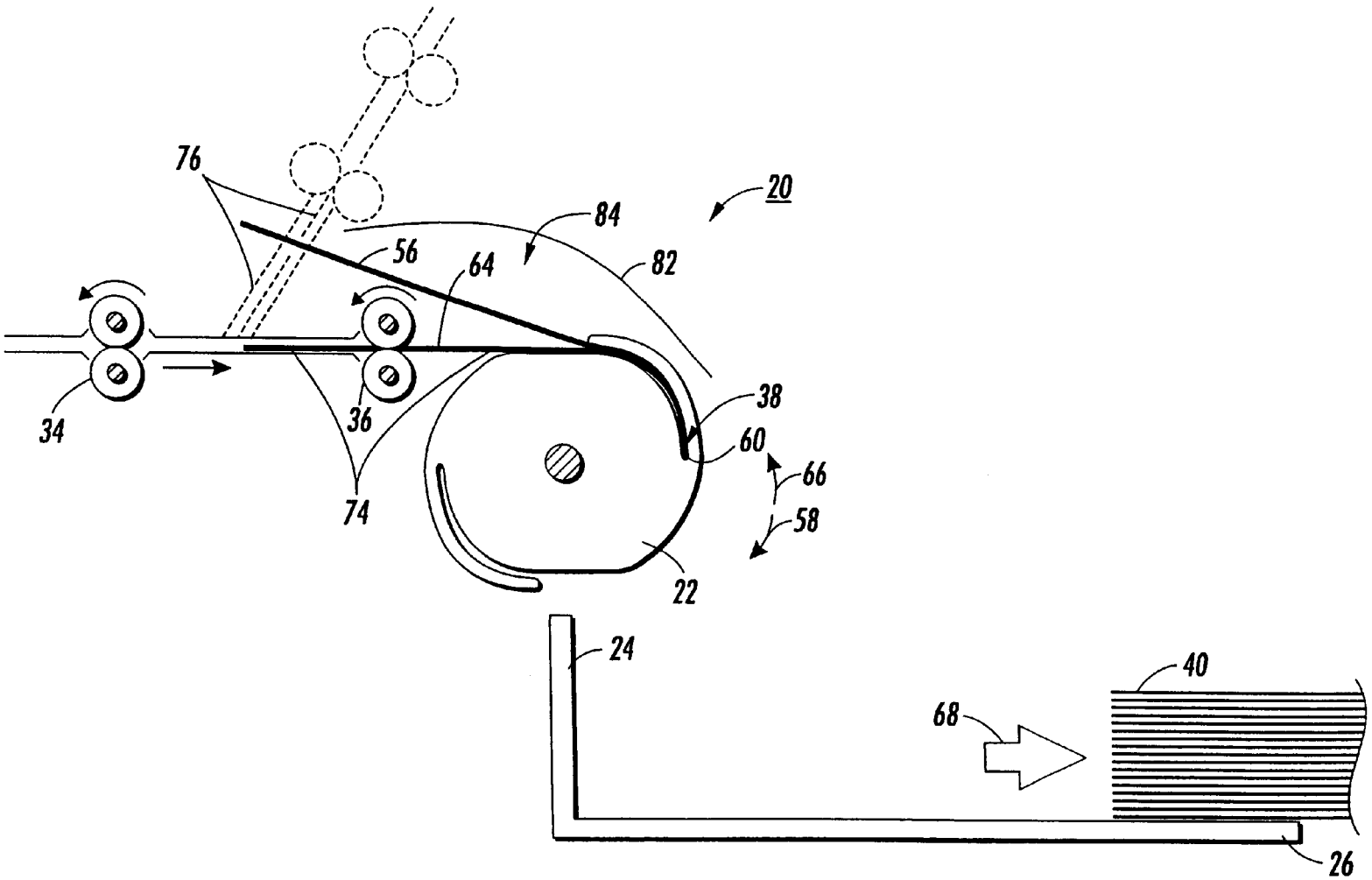
FIG. 7 is a schematic side view of a disk stacking section receiving a second sheet of material on a rotatable disk.

In FIG. 7 there is shown a schematic side view of disk stacking section 20 receiving a second sheet of material 64 on rotatable disk 22 at a first location. Disk input roller 36 feeds second sheet of material 64 along first paper path 74 into slot 38 of rotatable disk 22 adjacent first sheet of material 56. This operation acts to buffer the first sheet of material with the second sheet of material. First sheet of material 56 acts as a guide in conjunction with slot 38 for second sheet of material 64. First sheet of material may cross second paper path 76 as shown if so required. Rotatable disk 22 is shown at a sheet receiving position, but alternately may be stationary in a different position or rotating in either the forward direction 58 or reverse direction 66, approaching or leaving the sheet receiving position as second sheet of material 64 is fed into slot 38. As the lead edge of the second sheet of material 64 begins to enter slot 38, the disk may begin to rotate in the forward direction 58. Disk 22 may be rotated at a velocity so that the leading edge of the second sheet of material 64 progressively enters disk slot 38. Disk 22 may, but not need, be rotated at an appropriate speed so that the leading edge of the second sheet of material 64 contacts slot end 60. Stack of material 40 is shown schematically being indexed off of tray 26 in direction 68 to allow the next stacking operation to proceed.

Figure 8:
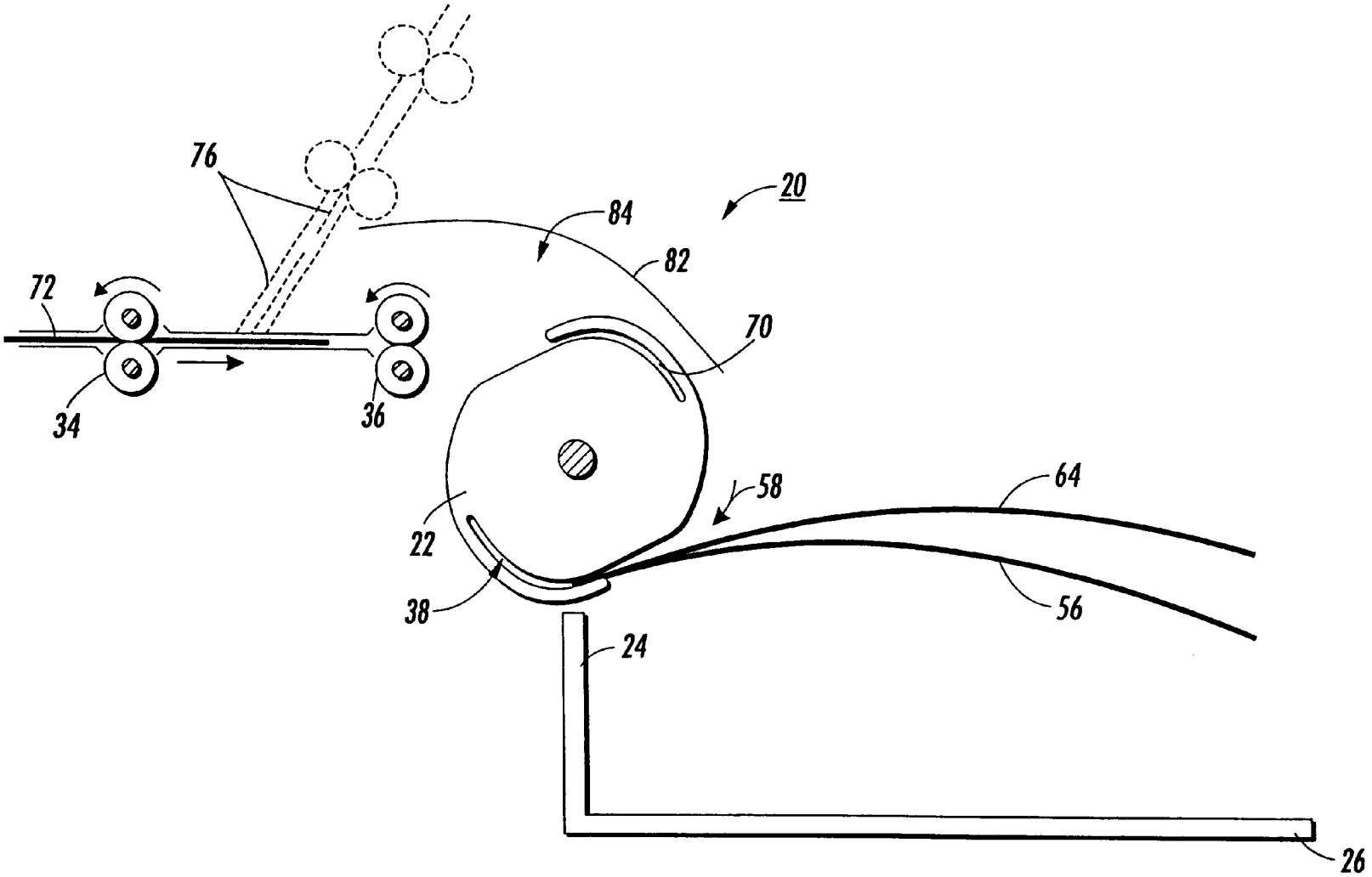
FIG. 8 is a schematic side view of a disk stacking section stacking a first and second sheet of material with a rotatable disk.

In FIG. 8 there is shown a schematic side view of disk stacking section 20 rotating first sheet of material 56 and a second sheet of material 64 on rotatable disk 22 at a stacking location. After the trailing edge of second sheet of material 64 clears disk input roller 36, rotatable disk 22 rotates in forward direction 58 up to and/or through a stacking location where the leading edges of first and second sheets of material 56 and 64 contact registration wall 24. First and second sheets of material 56 and 64 will fall to tray 26 to start a new stack or will fall to rest on a finished stack of sheets. Sheets of material 55 and 64 may then be acted upon by tampers or guides (not shown) that are used to insure alignment of the stack of sheets of material. Input roller 34 feeds third sheet of material 72 toward disk input roller 36. Disk input roller 36 then feeds third sheet of material 72 into slot 70 of rotatable disk 22 to allow the typical stacking operation before described to proceed for the remainder of the stack.

With the foregoing description, the buffering allows the copier or printer into which the stacker has been incorporated to continue operating during the finishing operation(s) without having to stop the machine or skip sheets being processed, thus allowing continuous operation during finishing operations. Where the finishing operation would require more time than buffering a single sheet would allow, the method and apparatus may be applied to include buffering third or subsequent sheets with the first and second sheet before depositing the set of sheets buffered on the tray. It has been shown that buffering sheets according to the present invention results in 90 pages per minute on a machine running two sheet sets as compared to 60 pages per minute on the same machine running two sheets sets that skips a sheet pitch during the finishing operation. Accordingly, a sheet stacking device that is capable of buffering sheets while a finishing operation is being performed on a printed or copied stack of sheets is provided as desired.

It should be understood that the foregoing description is only illustrative of the invention. Various alternatives and modifications can be devised by those skilled in the art without departing from the invention. Such an alternative, for example, may include buffering the third or subsequent sheets with the first and second sheet before depositing the first and second sheet on the tray. Accordingly, the present invention is intended to embrace all such alternatives, modifications and variances which fall within the scope of the appended claims.

What is claimed is:

1. A sheet stacker for transporting and stacking sheets of material, the sheet stacker comprising:

a rotatable disk adapted to receive at least two of the sheets of material; and a controller connected to the rotatable disk, the controller being adapted to reversibly control a position of the rotatable disk;

wherein, after a first sheet of material is received onto the rotatable disk by forward rotation of the rotatable disk, the controller is adapted to reverse the rotation of the rotatable disk, and wherein the rotatable disk can then receive a second sheet of material adjacent the first sheet of material.

2. A document creating apparatus comprising an image transfer system for transferring images onto sheets of material and the sheet stacker according to claim 1 coupled to the image transfer system.

3. The document creating apparatus of claim 2 wherein the image transfer system comprises a xerographic copier.

4. The document creating apparatus of claim 2 wherein the image transfer system comprises a printer.

5. The document creating apparatus of claim 2 wherein the sheet stacker further comprises a tray adapted to stack sheets of material thereon.

6. The sheet stacker of claim 1 wherein the controller is further adapted to rotate the rotatable disk by forward rotation to or past a sheet stacking position after the rotatable disk receives the second sheet of material adjacent the first sheet of material.

7. The sheet stacker of claim 6 further comprising a tray adapted to stack sheets of material thereon at the sheet stacking position.

8. A method of stacking sheets of material in a sheet stacker comprising the steps of:

receiving a first sheet of material on a rotatable disk;

rotating the rotatable disk in a first direction;

reversing the rotation of the rotatable disk;

receiving a second sheet of material adjacent the first sheet of material on the rotatable disk; and rotating the rotatable disk with the first and second sheets of material in the first direction.

9. The method of stacking sheets of material in a sheet stacker of claim 8 further comprising the step of stacking the first and second sheets of material at a stacking location.

10. The method of stacking sheets of material in a sheet stacker of claim 8 wherein the step of receiving a first sheet of material on a rotatable disk includes driving the first sheet of material along a paper path into a slot on the rotatable disk.

11. The method of stacking sheets of material in a sheet stacker of claim 8 wherein the step of receiving a second sheet of material adjacent the first sheet of material on the rotatable disk includes guiding the second sheet of material with the first sheet of material along a paper path into a slot on the rotatable disk.

* * * * *